US007258433B2

(12) United States Patent
Youn

(10) Patent No.: US 7,258,433 B2
(45) Date of Patent: Aug. 21, 2007

(54) ARRAY INKJET HEAD AND INKJET IMAGE FORMING APPARATUS HAVING THE SAME

(75) Inventor: Karp-sik Youn, Hwseong-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 123 days.

(21) Appl. No.: 11/254,702

(22) Filed: Oct. 21, 2005

(65) Prior Publication Data

US 2006/0164464 A1 Jul. 27, 2006

(30) Foreign Application Priority Data

Jan. 26, 2005 (KR) ..... 10-2005-0007230

(51) Int. Cl.
*B41J 2/175* (2006.01)

(52) U.S. Cl. ..... 347/86; 347/42

(58) Field of Classification Search ..... 347/42, 347/86, 101

See application file for complete search history.

(56) References Cited

U.S. PATENT DOCUMENTS 5,420,621 A * 5/1995 Richtsmeier et al. ..... 347/104
5,593,240 A 1/1997 Broder
2006/0066670 A1* 3/2006 Kang ..... 347/42

FOREIGN PATENT DOCUMENTS

| | | |
|---|---|---|
| JP | 06-115195 | 4/1994 |
| JP | 11-138923 | 5/1999 |
| JP | 2003-252505 | 9/2003 |
| JP | 2003-306260 | 10/2003 |
| JP | 2003-334976 | 11/2003 |
| KR | 20-1999-0017801 | 6/1999 |
| KR | 20-1999-0032183 | 7/1999 |

* cited by examiner

*Primary Examiner*—Thinh Nguyen
(74) *Attorney, Agent, or Firm*—Roylance, Abrams, Berdo & Goodman, L.L.P.

(57) ABSTRACT

An array inkjet head includes a body in which a space for accommodating ink is formed. A nozzle unit is formed on the body, and ejects ink from the body. The length of the nozzle unit substantially corresponds to the width of printing paper in a main scanning direction. A plurality of star wheels are rotatably disposed in the body in the main scanning direction proximal an exit end of the nozzle unit. A portion of the plurality of star wheels protrudes from the body.

26 Claims, 9 Drawing Sheets

ARRAY INKJET HEAD AND INKJET IMAGE FORMING APPARATUS HAVING THE SAME

BACKGROUND OF THE INVENTION

This application claims the benefit under 35 U.S.C. § 119(a) of Korean Patent Application No. 10-2005-0007230, filed on Jan. 26, 2005 in the Korean Intellectual Property Office, the entire disclosure of which is hereby incorporated by reference.

FIELD OF INVENTION

The present invention relates to an inkjet head and an inkjet image forming apparatus having the same. More particularly, the present invention relates to an array inkjet head including nozzle units having a length substantially corresponding to the width of a printing paper, and an inkjet image forming apparatus having the array inkjet head.

DESCRIPTION OF THE RELATED ART

As illustrated in FIG. 1, a conventional inkjet image forming apparatus forms an image by ejecting ink I onto printing paper P through a nozzle unit 2 of an inkjet head 1(that is, a shuttle inkjet head), which reciprocates in a perpendicular direction with respect to the transportation direction of the printing paper P. The inkjet head 1 is a predetermined distance from the top surface of the printing paper P. The ink I, accommodated inside the inkjet head 1, is supplied to the nozzle unit 2. The printing paper P is transported while being maintained a predetermined distance from the nozzle unit 2. A star wheel 3 in point contact with the top surface of the printing paper P is installed at an exit part of the nozzle unit 2 so that the printing paper P in transit does not contact the nozzle unit 2. Preferably, the star wheel 3 is installed close to the nozzle unit 2. The exit part of the nozzle unit 2 is cut away as illustrated in FIG. 1 to secure the star wheel 3. However, this decreases the space inside the inkjet head 1 such that less ink I is accommodated within the inkjet head 1.

High speed printing is obtained using an inkjet head (an array printing head, which is not shown) having a nozzle unit in which the length of the nozzle unit corresponds to the width of the printing paper P in the main scanning direction instead of the inkjet head 1 which reciprocates in the width direction of the printing paper P. In an inkjet image forming apparatus having the array printing head, an ink jet head does not move and only the printing paper P is transported. Therefore, the structure of a driving device of the inkjet image forming apparatus is simplified, and high speed printing is achieved. However, the space inside the inkjet head for storing ink is decreased to install a star wheel 3 close to the nozzle unit.

Thus, a need exists for an inkjet image forming apparatus having an array inkjet head that maximizes the ink storage volume.

SUMMARY OF THE INVENTION

The present invention provides an improved array inkjet head so that a space or volume to accommodate ink is maximized, and an inkjet image forming apparatus having the array inkjet head.

According to an aspect of the present invention, an array inkjet head includes a body in which a space for accommodating ink is formed. A nozzle unit is formed on the body from which ink is ejected. The length of the nozzle unit substantially corresponds to the width of a printing paper in the main scanning direction. A plurality of star wheels are disposed in the main scanning direction to rotate at an exit end of the nozzle unit. A portion of the plurality of star wheels protrudes from the body.

According to another aspect of the present invention, an inkjet image forming apparatus includes a transport unit for transporting printing paper. An array inkjet head has a body in which a space for accommodating ink is formed. A nozzle unit is formed on the body, from which ink is ejected. The length of the nozzle unit substantially corresponds to the width of the printing paper in the main scanning direction. A plurality of star wheels are disposed in the main scanning direction to rotate at an exit end of the nozzle unit. A portion of the plurality of star wheels protrudes from the body. A platen is placed facing the nozzle unit and supports the bottom surface of the printing paper.

The array inkjet head may further include an elastic element that elastically biases the star wheels in the direction in which the star wheels protrude from the body. The elastic element may also act as a rotation axis of the star wheels.

The inkjet image forming apparatus may further include a plurality of support rollers facing the plurality of star wheels and supporting the bottom surface of the printing paper.

The array inkjet head may further include a protection cover installed on the body that is adapted to move the protection cover to a first location to cover the star wheels and to a second location to expose the star wheels. For example, the protection cover may cover the star wheel and the nozzle unit when the protection cover is placed at the first location.

The inkjet image forming apparatus may further include an interfering unit that pivots the protection cover to the second location when the array inkjet head is being installed in the inkjet image forming apparatus.

The array inkjet head may further include a plurality of guide rollers rotatably installed on the body at an entrance end of the nozzle unit that guides the top surface of the printing paper.

The array inkjet head further includes a bracket coupled to the body, and the plurality of star wheels are rotatably coupled to the bracket.

Preferably, at least two rows of the plurality of star wheels are installed in a sub-scanning direction. The inkjet image forming apparatus further includes a plurality of support rollers facing the plurality of star wheels and supporting the bottom surface of the printing paper.

Other objects, advantages, and salient features of the invention will become apparent from the detailed description, which, taken in conjunction with the annexed drawings, discloses preferred exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Exemplary embodiments of the present invention will now be described more fully with reference to the accompanying drawings, in which exemplary embodiments of the invention are shown.

Figure 1:
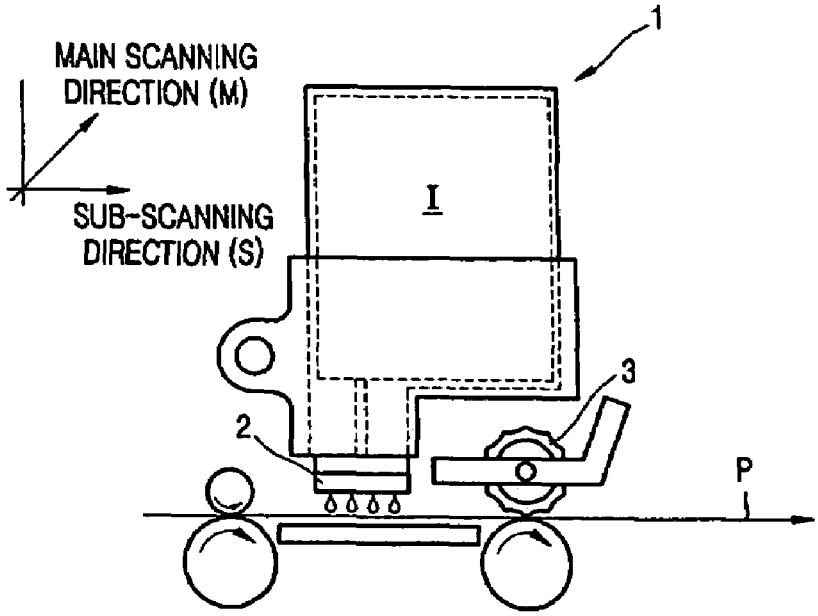
FIG. 1 (PRIOR ART)
FIG. 1 is a diagram of a conventional inkjet image forming apparatus.
Figure 2:
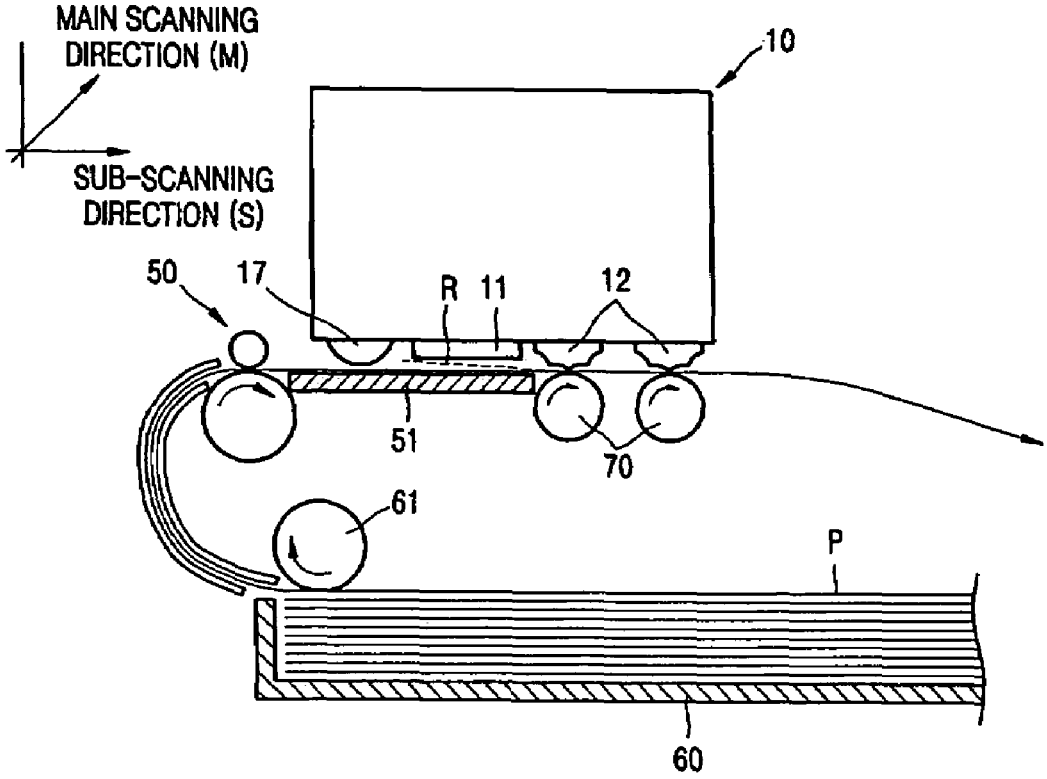
FIG. 2 is a diagram of an inkjet image forming apparatus according to an exemplary embodiment of the present invention.
Figure 3:
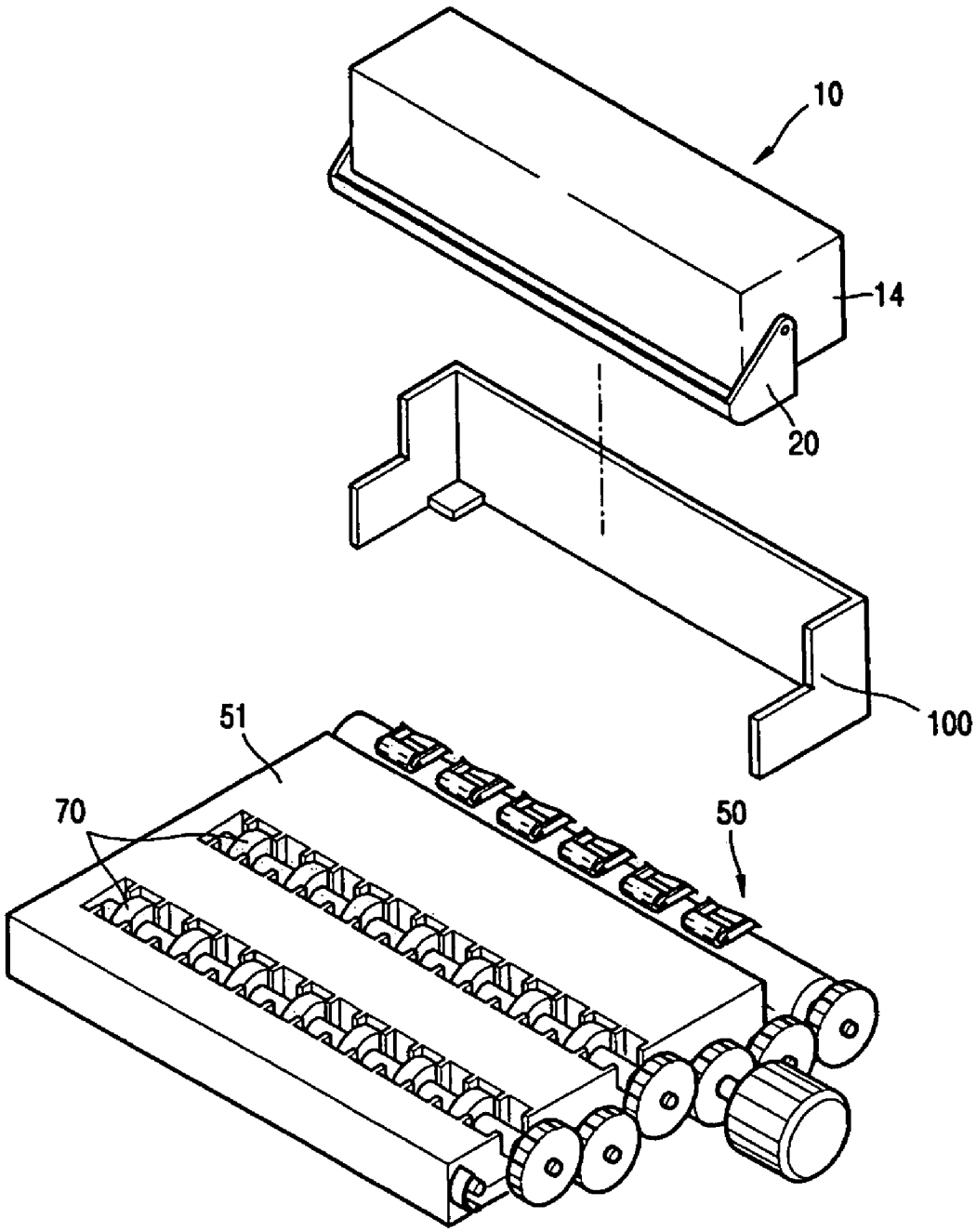
FIG. 3 is an exploded perspective view of the inkjet image forming apparatus of FIG. 2.

FIG. 2 is a diagram of an inkjet image forming apparatus according to an exemplary embodiment of the present invention. FIG. 3 is an exploded perspective view of the inkjet image forming apparatus of FIG. 2. Referring to FIGS. 2 and 3, the inkjet image forming apparatus includes an array inkjet head 10, a platen 51 facing the array inkjet head 10, and a transport unit 50 that transports printing paper P. The printing paper P is stacked in a paper cassette 60, and is picked up by a pickup roller 61 to be supplied to the transport unit 50. The transport unit 50 transports the printing paper P at a predetermined printing speed. The platen 51 supports the bottom surface of the printing paper P, and maintains a distance between a nozzle unit 11 and the top surface of the printing paper P. The distance between the nozzle unit 11 and the top surface of the printing paper P is preferably about 0.5-2.5 mm.

Figure 4:
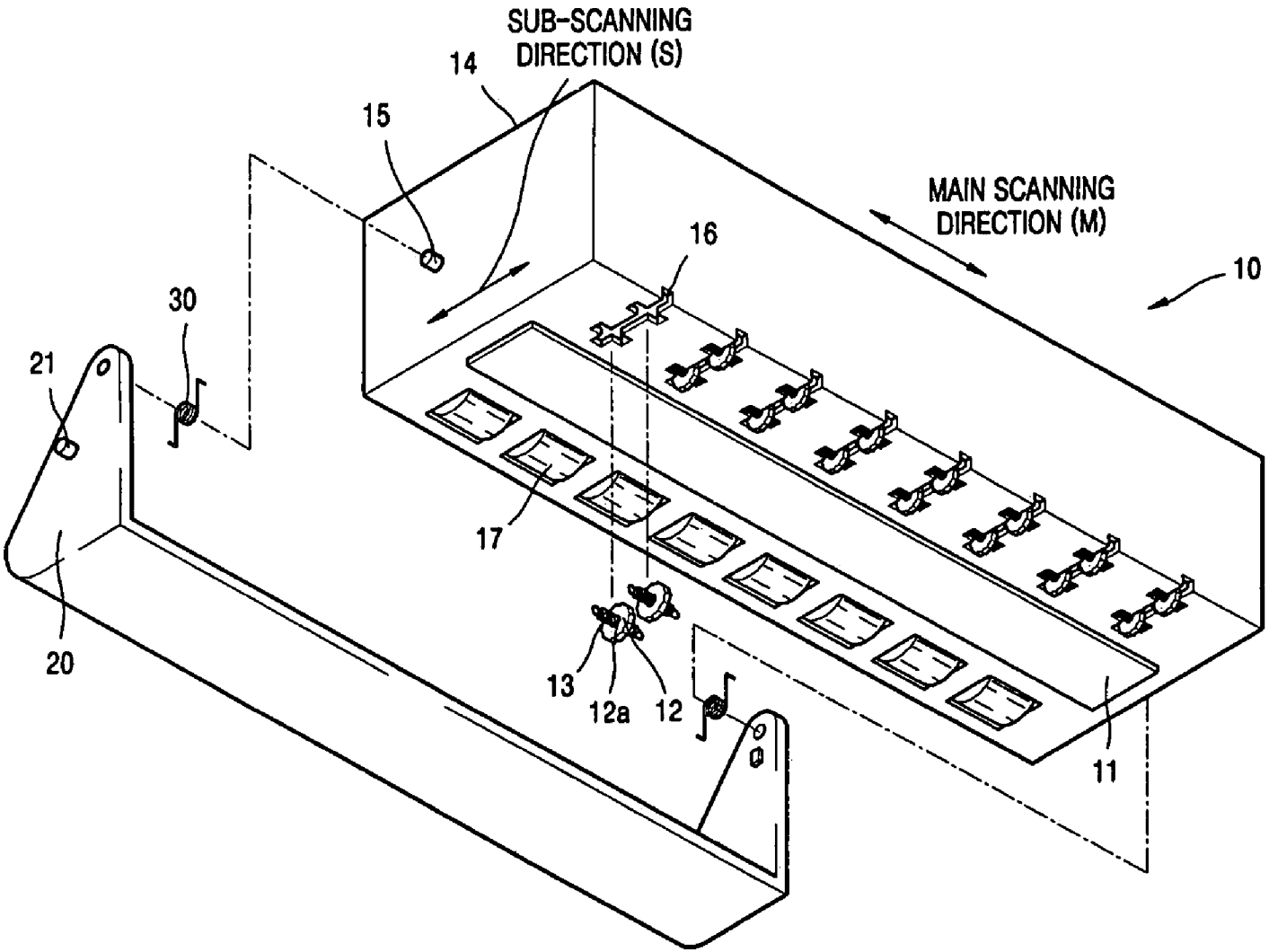
FIG. 4 is an exploded perspective view of an array inkjet head according to an exemplary embodiment of the present invention.
Figure 5:
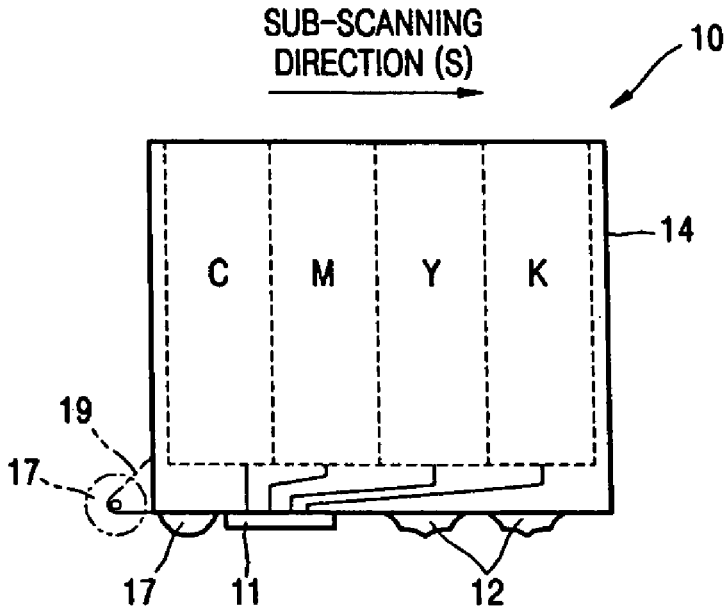
FIG. 5 is a side elevational view of the array inkjet head of FIG. 4.
Figure 6:
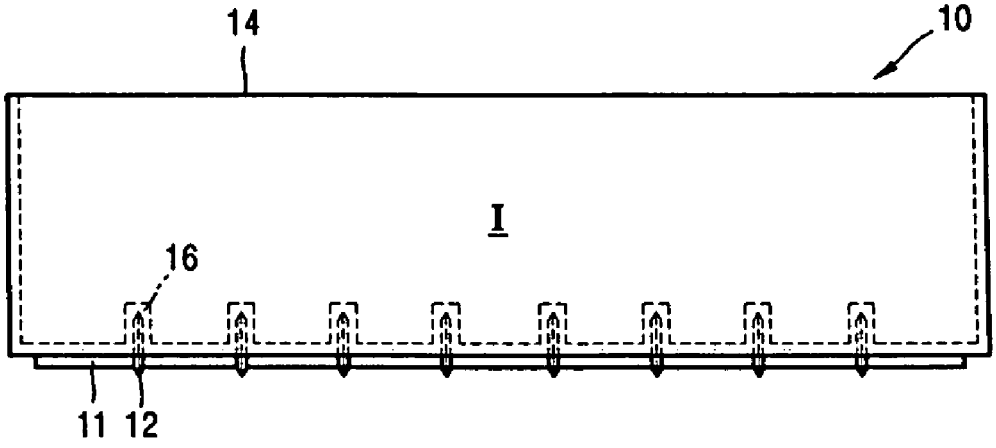
FIG. 6 is a front elevational view of the array inkjet head of FIG. 4.

FIGS. 4 through 6 are an exploded perspective view, a side elevational view, and a front elevational view of the array inkjet head 10 in the inkjet image forming apparatus of FIGS. 2 and 3.

Figure 7:
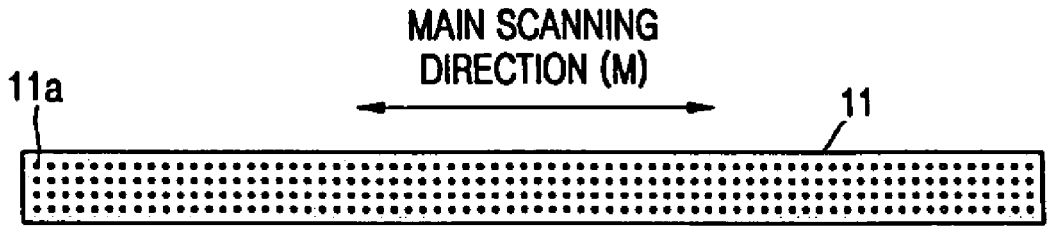
FIG. 7 is a diagram of a nozzle unit according to an exemplary embodiment of the present invention.

Referring to FIGS. 4 through 6, the inkjet head 10 includes a body 14, and the nozzle unit 11 is placed on the bottom surface of the body 14. A star wheel 12 is rotatably installed proximal an exit part of the nozzle unit 11. As illustrated in FIG. 7, a plurality of nozzles 11*a*, which eject ink I, are disposed in the main scanning direction M. The nozzle unit 11 preferably includes four nozzle rows, each row ejecting cyan, magenta, yellow, and block color inks I to print a color image. The length of the nozzle unit 11 is substantially the same as the width of the print paper P in the main scanning direction M. The ink I is accommodated inside the body 14. The body 14 may be divided into four storage spaces, or volumes, as illustrated in FIG. 5 to accommodate respective cyan, magenta, yellow, and black color inks I. Although not illustrated in the drawings, chambers are connected to each of the nozzles 11*a* and include ejecting elements (for example, piezo actuators or heaters), which provide pressure to eject the ink I. A channel in the body 14 supplies the ink I accommodated inside the body 14 to the chambers. The chambers, the ejecting elements, and the channel are well known to those skilled in the relevant art to which the exemplary embodiments of the present invention pertain, and thus, detailed descriptions thereof are omitted. The nozzle unit 11 may be configured in various ways in addition to the exemplary embodiment illustrated in FIG. 7.

Figure 8:
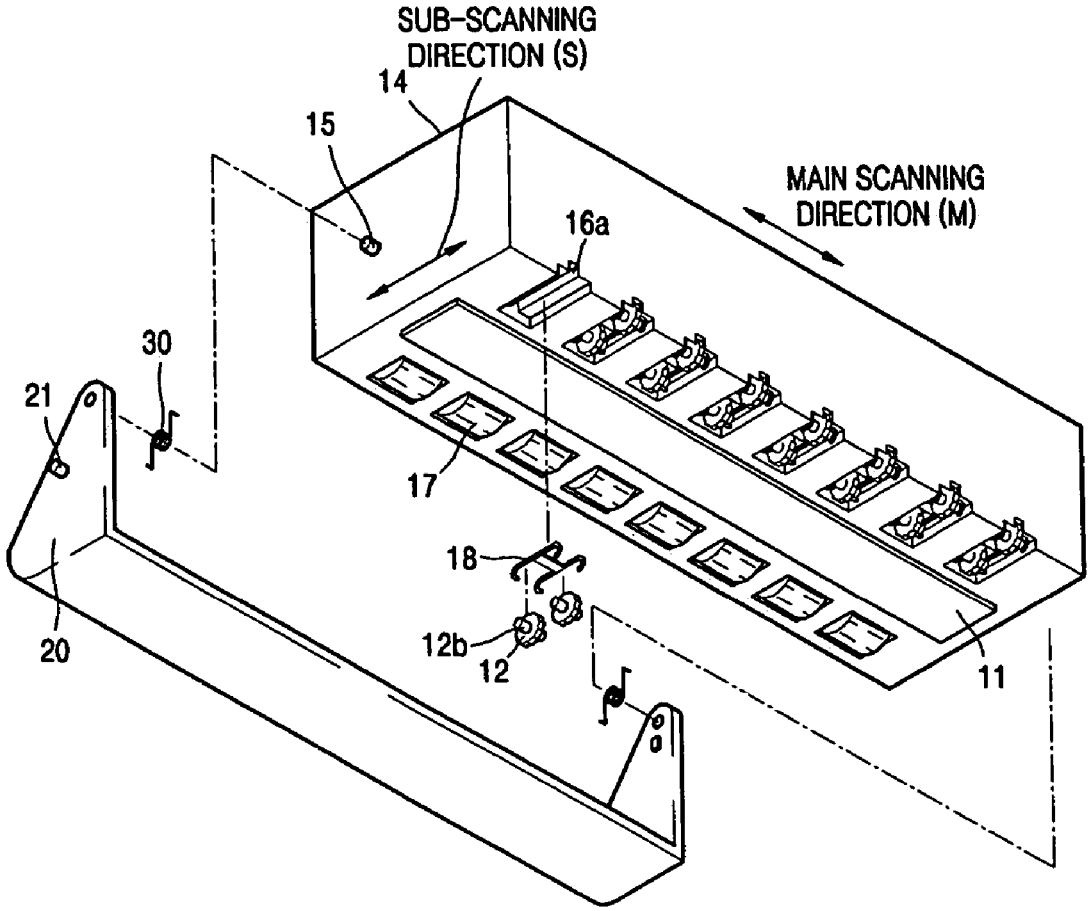
FIG. 8 is an exploded perspective view of an array inkjet head according to another exemplary embodiment of the present invention.
Figure 9:
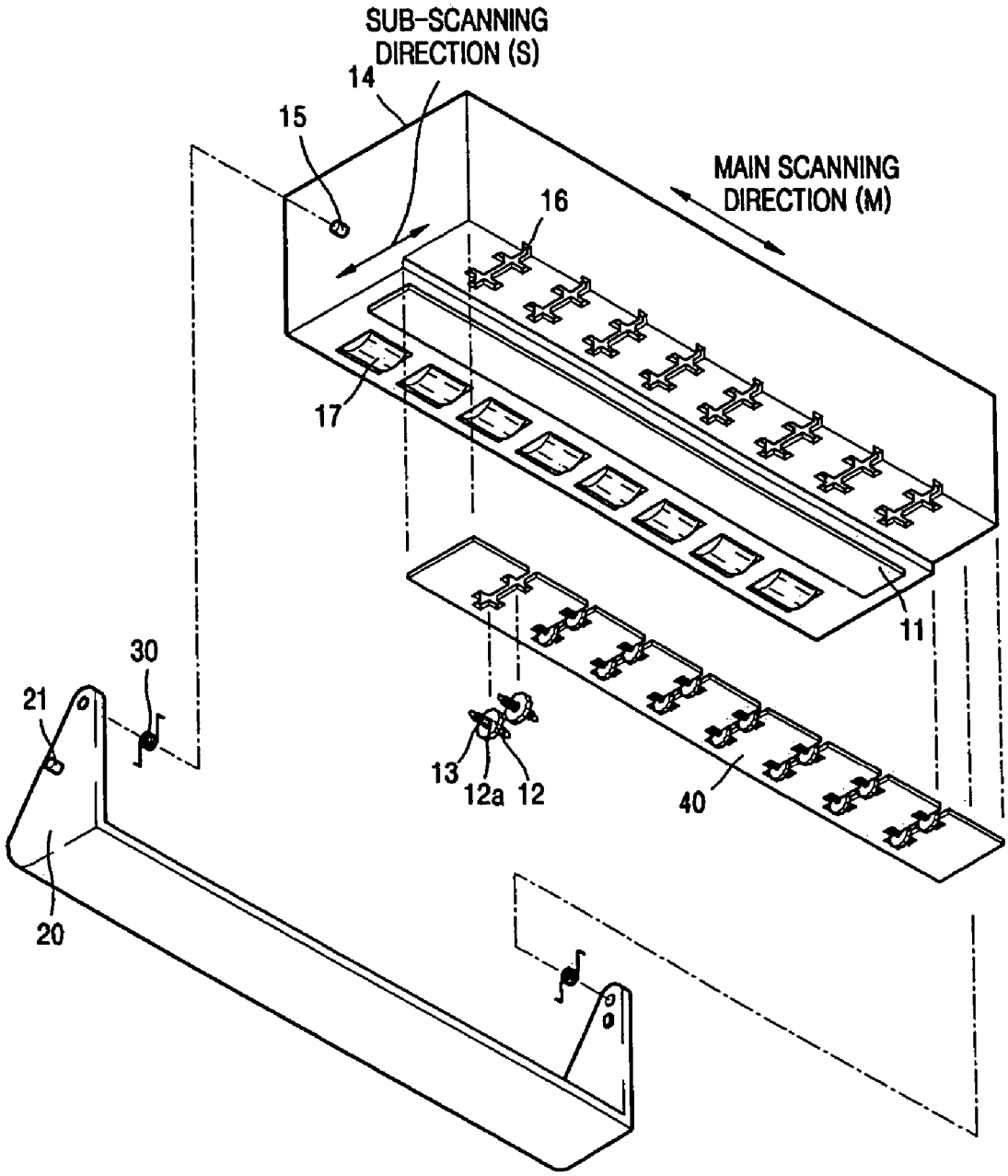
FIG. 9 is an exploded perspective view of an array inkjet head according to another exemplary embodiment of the present invention.

The printing paper P has ink I ejected onto the top surface thereof while passing through the nozzle unit 11 of a conventional image forming apparatus, and may become wavy because the printing paper P gets wet from the ink I. When the printing paper P becomes wavy, the printing paper P may contact the nozzle unit 11 or the bottom surface of the body 15, and thus, the wet ink I may spread and distort the printed image. Additionally, there is a possibility that the distance between the printing paper P and the nozzle unit 10 may not be maintained. In an exemplary embodiment of the present invention, star wheels 12 substantially prevent the printing paper P being transported below the nozzle unit 11 from contacting the nozzle unit 11 or the bottom surface of the body 14, and substantially prevent the distance between the printing paper P and the nozzle unit 11 from changing. Therefore, the star wheels 12 are installed on the body 14 such that at least one portion of the star wheels 12 protrudes further than the nozzle unit 11, and are in contact with the top surface of the printing paper P. The plurality of star wheels 14 are disposed in the main scanning direction M. A plurality of recesses 16 are formed in the bottom surface of the body 14. Extension coil springs 13 are inserted in through-holes 12*a* of the star wheels 12. Both ends of the extension coil springs 13 are fixed to the recesses 16 of the body 14. The extension coil spring 13 is an example of an elastic element that elastically biases the star wheels 12 in the direction in which the star wheels 12 protrude from the body 14. The star wheels 12 contact the top surface of the printing paper P by the elastic force of the extension coil strings 13, thereby stably guiding the printing paper P. Additionally, the extension springs 13 act as a rotating axis. Another example of the elastic element is a leaf spring 18, as illustrated in FIG. 8. Referring to FIG. 8, a plurality of star wheels 12 are rotatably coupled to the leaf springs 18. The leaf springs 18 are coupled to recesses 16 formed in a body 14 of an array inkjet head 10. Additionally, a bracket 40 may be coupled to the body 14, and the plurality of star wheels 12 are rotatably connected to the bracket, as illustrated in FIG. 9.

When the plurality of star wheels 12 are installed on the body 14 of the array inkjet head 10 or the bracket 40 is installed on the body 14, the space within the body 14, except for where the recesses 16 are formed, is used to accommodate the ink I, as illustrated in the dotted lines in FIGS. 5 and 6. Therefore, the capacity of the array inkjet head 10 is efficiently used as a space to accommodate the ink I.

The transport unit 50 is preferably installed proximal to the nozzle unit 11. However, there is a limit to how close the transport unit 50 may be installed to the nozzle unit 11 because the distance between the nozzle unit 11 and the platen 51 is very narrow. The distance between the printing paper P and the nozzle unit 11 is unstable until the leading end of the printing paper P reaches the star wheels 12 when the printing paper P is transported below the nozzle unit 11 by the transport unit 50. In borderless printing with a conventional image forming apparatus, an image with inferior quality may be printed on the leading end of the printing paper P. Additionally, the leading end of the printing paper P may contact the nozzle unit 11. In an exemplary embodiment of the present invention, the array inkjet head 10 further includes a plurality of guide rollers 17 that are rotatably coupled to the body 14. The guide rollers 17 are placed at an entrance end of the nozzle unit 11 to press the top surface of the printing paper P so that the printing paper P does not contact the nozzle unit 11 while maintaining a distance between the nozzle unit 11 and the printing paper P. The plurality of guide rollers 17 are disposed in the main scanning direction M. Although the guide rollers 17 are not illustrated in detail in the drawings, the guide rollers 17 are installed on the body 14 in a manner substantially similar to the star wheels 12, such that a portion of the guide roller 17 is recessed in the body 14. As a result, the guide rollers 17 take up a minimum amount of space to be used to accommodate the ink I in the body 14. Additionally, the guide rollers 17 may be installed on arms 19 extended from the body 14, as illustrated in the dashed lines in FIG. 5.

When the trailing end of the printing paper P passes the transport unit 50 (or the guide rollers 17), the trailing end of the printing paper P is lifted up as illustrated in the dashed lines R in FIG. 2, thereby contacting the nozzle unit 11 and contaminating the printing paper P. Particularly, when performing borderless printing, an image printed on the trailing end of a printing paper P may be contaminated. Two rows of a plurality of star wheels 12 may be installed in the sub-scanning direction S. Then, the trailing end of the printing paper P is substantially prevented from being lifted up because the plurality of star wheels 12, separated from each other in the sub-scanning direction S of the printing paper P, are pressing the printing paper P at two points. Additionally, the body 14 may be extended in the sub-scanning direction S, as illustrated in FIG. 5, to accommodate a greater amount of ink I in the array inkjet head 10. Preferably, at least two rows of the plurality of star wheels 12 are installed in the sub-scanning direction S.

The inkjet image forming apparatus may further include support rollers 70 facing the plurality of star wheels 12 and supporting the bottom surface of the printing paper P, as illustrated in FIGS. 2 and 3. The extension coil springs 13 (or the leaf springs 18) elastically bias the plurality of star wheels 12 toward the support rollers 70. According to the above-described structure, the star wheels 12 and the support rollers 70 also act as an ejecting element, which discharges the printing paper P. When at least two rows of the plurality of star wheels 12 are installed in the sub-scanning direction S, a plurality of support rollers 70 that substantially correspond to the respective star wheels 12 are installed in the inkjet image forming apparatus.

The array inkjet head 10 may further include a protection cover 20 to protect the star wheels 12. The protection cover 20 moves between a first location (FIG. 10), which covers the star wheels 12, to a second location (FIG. 11), which exposes the star wheels 12. Referring to FIG. 4, a boss 15 extends outwardly from both sidewalls of the body 14 of the array inkjet head. The protection cover 20 is pivotably coupled to the bosses 15 to pivot between the first and second locations. Springs 30 elastically bias the protection cover 20 in the first direction. The protection cover 20 substantially prevents damage to the star wheels 12 when dismantling the array inkjet head 10 from the inkjet image forming apparatus.

Figure 10:
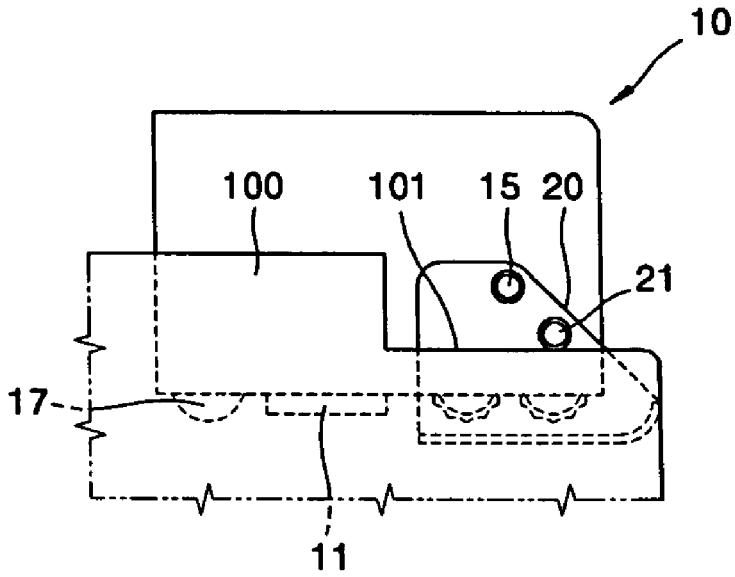
FIGS. 10 and 11 are diagrams illustrating the movement operation of a protection cover of an exemplary embodiment of the present invention.
Figure 11:
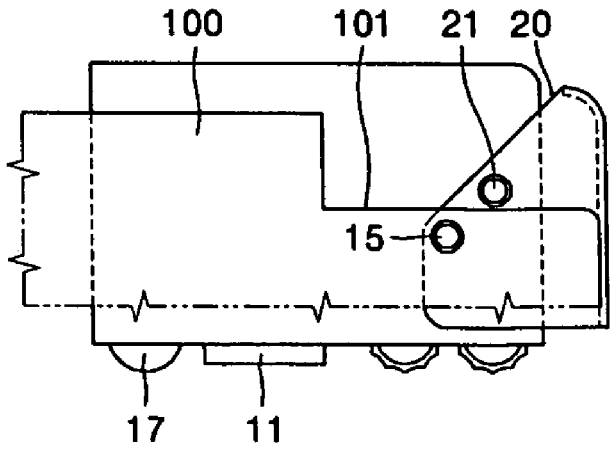

The protection cover 20 may be installed in the inkjet image forming apparatus after a user manually moves the protection cover 20 to the second location. Additionally, when installing the array inkjet head 10 in the inkjet image forming apparatus, the protection cover 20 may automatically move to the second location. Referring to FIGS. 10 and 11, the inkjet image forming apparatus further includes an interfering unit 101. The interfering unit 101 is placed, for example, on both sides or one side of the frame 100, when the array inkjet head 10 is mounted on the frame 100. A protrusion 21 is formed on both sides or one side of the protection cover 20. When mounting the array inkjet head 10 on the frame 100, the protrusion 21 is engaged by the interfering unit 101, as illustrated in FIG. 10. Then, the protection cover 20 pivots to the second location with the boss 15 as the rotation axis, as illustrated in FIG. 11. When the array inkjet head 10 is removed from the inkjet image forming apparatus, the protection cover 20 returns to the first location by the force of recovery of the spring 30.

Figure 12:
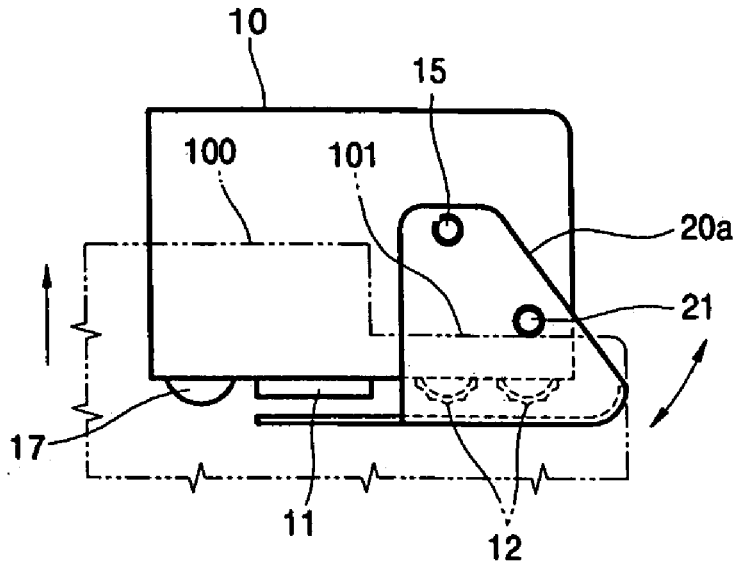
FIG. 12 is an elevational view of another exemplary embodiment of the protection cover illustrated in FIGS. 10 and 11.
Figure 13:
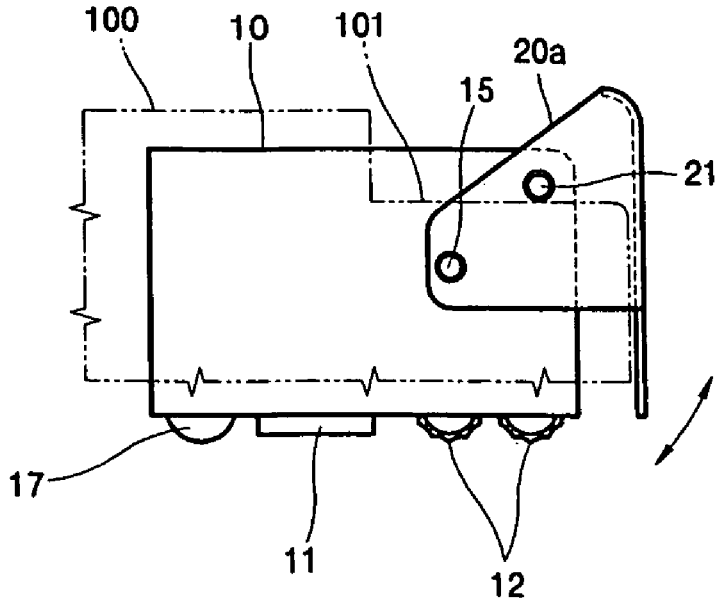
FIG. 13 is an elevational view of the protection cover of FIG. 12 illustrating the movement operation of the protection cover.

As illustrated in FIGS. 12 and 13, a protection cover **20*a* may extend to the nozzle unit 11. When the protection cover 20*a* is placed at a first location (illustrated in FIG. 12), the protection cover 20*a* covers the star wheel 12 and the nozzle unit 11. When the protection cover 20*a* is placed at a second location(illustrated in FIG. 13), the nozzle unit 11 and the star wheel 12 are exposed to the outside. According to such a structure, the protection cover 20*a* substantially prevents damage to the star wheel 12 and the nozzle unit 11 when removing the inkjet head 10** from the inkjet image forming apparatus.

According to the above-described inkjet head and an inkjet image forming apparatus having the same, the following effects may be achieved.

First, by coupling a plurality of star wheels to an array inkjet head, the space in the array inkjet head may be effectively used as the space to accommodate ink.

Second, by installing at least two rows of the star wheels, contamination of the trailing end of a printing paper may be substantially prevented. Also, the space to accommodate the ink may be enlarged by extending the body of the array inkjet head in the sub-scanning direction.

Third, the top surface of the printing paper may be stably guided by elastically contacting the star wheels with the top surface of the printing paper using elastic elements.

Fourth, damage to the star wheels may be prevented when the array inkjet head is removed from the inkjet image forming apparatus by including a protection cover on the array inkjet head. Additionally, convenience for a user may be increased by moving the protection cover to the second location while mounting the array inkjet head in the inkjet image forming apparatus.

Fifth, by further including support rollers, the star wheels and the support rollers may also act as ejecting elements that output the printing paper.

Sixth, by further installing guide rollers on an exit end of a nozzle unit, contamination of the leading end of the printing paper may be substantially prevented.

Lastly, seventh, damage to the nozzle unit may be substantially prevented because the protection cover covers the nozzle unit when the protection cover is placed at a first location.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An array inkjet head, comprising:

a body having a space for storing ink;

a nozzle unit formed on the body and adapted to eject the ink, and the length of the nozzle unit substantially corresponds to the width of a printing paper in a main scanning direction; and a plurality of star wheels rotatably disposed in the body in the main scanning direction proximal an exit end of the nozzle unit such that a portion of the plurality of star wheels protrudes from the body.

2. The array inkjet head of claim 1, wherein an elastic element elastically biases the plurality of star wheels in the direction in which the plurality of star wheels protrude from the body.

3. The array inkjet head of claim 2, wherein the elastic element is a rotation axis of the plurality of star wheels.

4. The array inkjet head of claim 1, wherein a protection cover installed on the body is adapted to move between a first location to cover the plurality of star wheels and a second location to expose the plurality of star wheels.

5. The array inkjet head of claim 4, wherein the protection cover covers the star wheel and the nozzle unit when the protection cover is placed at the first location.

6. The array inkjet head of claim 1, wherein a plurality of guide rollers are rotatably installed on the body proximal an entrance end of the nozzle unit.

7. The array inkjet head of claim 1, wherein a bracket is coupled to the body, and the plurality of star wheels are rotatably coupled to the bracket.

8. The array inkjet head of claim 1, wherein at least two rows of the plurality of star wheels are installed in a sub-scanning direction.

9. The array inkjet head of claim 8, wherein a protection cover installed on the body is adapted to move between a first location to cover the plurality of star wheels and a second location to expose the plurality of star wheels.

10. The array inkjet head of claim 9, wherein the protection cover covers the star wheel and the nozzle unit when the protection cover is placed at the first location.

11. The array inkjet head of claim 8, wherein a plurality of guide rollers are rotatably installed on the body proximal an entrance end of the nozzle unit.

12. An inkjet image forming apparatus, comprising:

a transport unit for transporting a printing paper;

an array inkjet head including a body having a space for storing ink;

a nozzle unit formed on the body to eject the ink, the length of the nozzle unit substantially corresponding to the width of the printing paper in the main scanning direction; and a plurality of star wheels rotatably disposed in the body in the main scanning direction proximal an exit end of the nozzle unit, a portion of the plurality of star wheels protruding from the body; and a platen disposed facing the nozzle unit and supporting the bottom surface of the printing paper.

13. The inkjet image forming apparatus of claim 12, wherein the array inkjet head has an elastic element that elastically biases the plurality of star wheels in the direction in which the plurality of star wheels protrude from the body.

14. The inkjet image forming apparatus of claim 13, wherein the elastic element is a rotation axis of the plurality of star wheels.

15. The inkjet image forming apparatus of claim 13, wherein a plurality of support rollers face the plurality of star wheels and support the bottom surface of the printing paper.

16. The inkjet image forming apparatus of claim 12, wherein the array inkjet head has a protection cover installed on the body adapted to move between a first location to cover the plurality of star wheels and a second location to expose the plurality of star wheels.

17. The inkjet image forming apparatus of claim 16, wherein an interfering unit engages the protection cover to pivot the protection cover to the second location when the array inkjet head is being installed in the inkjet image forming apparatus.

18. The inkjet image forming apparatus of claim 17, wherein the protection cover covers the star wheel and the nozzle unit when the protection cover is placed at the first location.

19. The inkjet image forming apparatus of claim 18, wherein a protection cover installed on the body is adapted to move between a first location to cover the plurality of star wheels and a second location to expose the plurality of star wheels.

20. The inkjet image forming apparatus of claim 19, wherein an interfering unit engages the protection cover to pivot the protection cover to the second location when the array inkjet head is being installed in the inkjet image forming apparatus.

21. The inkjet image forming apparatus of claim 20, wherein the protection cover covers the star wheel and the nozzle unit when the protection cover is placed at the first location.

22. The inkjet image forming apparatus of claim 12, wherein the array inkjet head has a plurality of guide rollers rotatably installed on the body proximal an entrance end of the nozzle unit to guide the top surface of the printing paper.

23. The inkjet image forming apparatus of claim 12, wherein the array inkjet head has a bracket coupled to the body, and the plurality of star wheels are rotatably coupled to the bracket.

24. The inkjet image forming apparatus of claim 12, wherein at least two rows of the plurality of star wheels are installed in a sub-scanning direction.

25. The inkjet image forming apparatus of claim 24, wherein a plurality of support rollers face the plurality of star wheels and support the bottom surface of the printing paper.

26. The inkjet image forming apparatus of claim 24, wherein a plurality of guide rollers are rotatably installed on the body proximal an entrance end of the nozzle unit to guide the top surface of the printing paper.

* * * * *